United States Patent [19]

Buergel

[11] 4,270,352

[45] Jun. 2, 1981

[54] CYCLE-CONTROLLED SLIDING-VALVE IN A HEATING-CHAMBER COMBUSTION ENGINE

[76] Inventor: George K. Buergel, 6 Stone Rd., Plainview, N.Y. 11803

[21] Appl. No.: 11,856

[22] Filed: Feb. 13, 1979

[51] Int. Cl.[3] ..... F02G 1/00

[52] U.S. Cl. ..... 60/517; 91/234; 60/682

[58] Field of Search ..... 60/650, 682, 517; 91/234, 402, 325, 410

[56] References Cited

U.S. PATENT DOCUMENTS

| | | | |
|---|---|---|---|
| 3,910,160 | 10/1975 | Divine | 91/410 X |
| 4,096,689 | 6/1978 | Buergel | 91/401 X |
| 4,120,161 | 10/1978 | Gedeit | 60/682 |

*Primary Examiner*—Allen M. Ostrager

[57] ABSTRACT

A cycle controlled sliding valve in a heating chamber combustion engine is provided. The valve includes a piston disposed for reciprocal movement within a cylinder, a piston-extension disposed for movement within the cylinder, a connecting rod connected to the piston, a pinion carried by the connecting rod, and a rack engaged by the pinion. The rack engages the piston-extension such that the latter is capable of movement in the axial direction of the cylinder away from or towards the piston. Such movement is caused by the swinging of the connecting rod due to crankshaft rotation. A path is provided within the cylinder walls which leads to the heating chamber. When an opening in the piston-extension is aligned therewith, communication is established between the cylinder and the heating chamber. In operation, the path leading to the heating chamber will open later during the up-stroke and will close later during the down-stroke.

15 Claims, 5 Drawing Figures

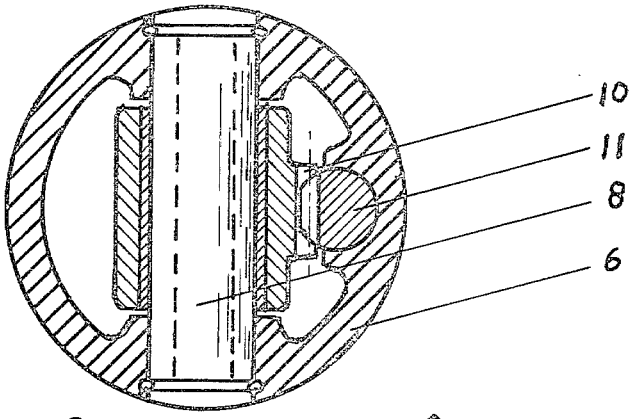
Fig 2
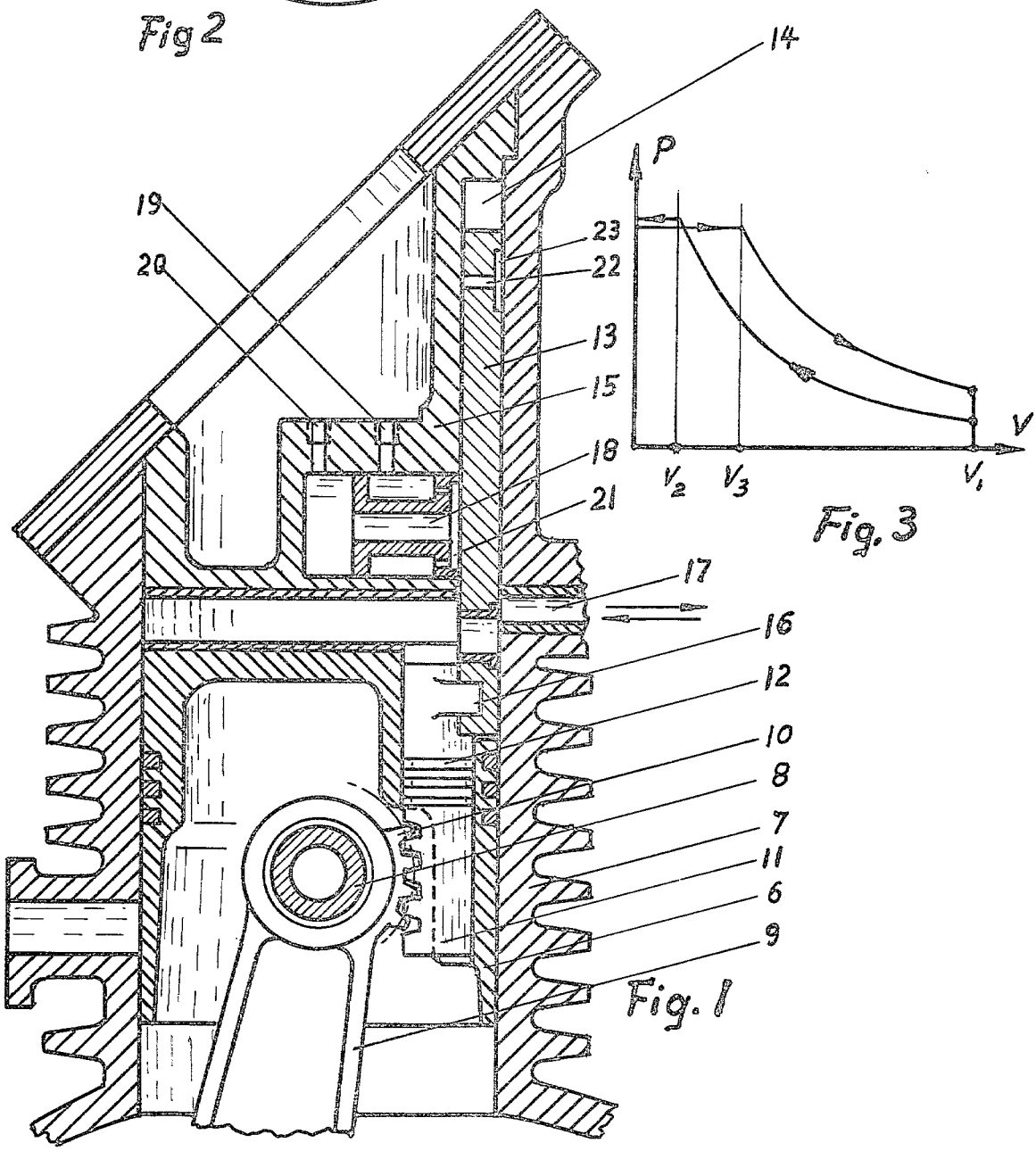
Fig. 3
Fig. 1

CYCLE-CONTROLLED SLIDING-VALVE IN A HEATING-CHAMBER COMBUSTION ENGINE

BACKGROUND OF THE INVENTION

A heating-chamber combustion engine is described in my U.S. Pat. No. 3,994,135, issued Nov. 30, 1976 and more so in my U.S. Pat. No. 4,096,689, issued June 27, 1978 and in a patent application Ser. No. 930,370 filed Aug. 2, 1978, in which a piston connected to a crankshaft moves up and down in a cylinder. In the lowest position of the piston the cylinder is flushed and filled with fresh air from a loading pump. This is the same as in all two-cycle combustion engines.

The air is then compressed by the up-going piston to ⅛ or 1/10 or even less of its original volume. As soon as the piston reaches the position at which the desired compression-ratio is achieved, a path opens, which connects the space above the piston with the interior of the heating-chamber, located adjacent to the cylinder. The piston does not stop its motion at this point. It continues further up and pushes the compressed air, which was trapped above the piston, thru the path into the adjacent heating-chamber, where it is heated by burning of fuel increasing the pressure in the chamber proportional to the absolute temperature.

SUMMARY OF THE NEW INVENTION

The so far patented engine has the disadvantage, that the opening and closing of the connecting path between the cylinder and the heating-chamber is timed symetrically to the upper dead-center. This means, that the volume of the air, which is enclosed in the cylinder at the moment of opening of the path to the heating-chamber is equal to the volume of the hot gases, which have flown from the heating-chamber into the cylinder at the moment of closing of the path. The increase of temperature, therefore, results in a high increase of the pressure in the heating-chamber above the designed compression-ratio. As soon as the path to the heating-chamber opens, the piston encounters this high pressure against which it has to work. This poses a heavy load to the crankshaft and the bearings.

An object of the invention is to provide different timing to permit heating of the compressed air at constant pressure and not, as before, at constant volume.

To achieve this, the path to the heating-chamber has to open later during the up-stroke and also to close later during the down-stroke. By retarding the opening of the path to the heating-chamber during the upstroke, higher compression occurs. By retarding the closing of the path during the down-stroke, a larger volume of air is permitted to enter the cylinder above the piston. This is accomplished as follows:

The upper end of the connecting-rod in the piston carries a segment of a pinion, which engages in a rack. The rack is moved up and down by the pinion. The piston-extension is attached to the rack, which slides in a hole of the piston. This way, the piston-extension is moved up and down in relation to the piston during the course of a working cycle. By using two opposing piston-extensions, each connected to a separate rack, and providing opposing paths in the cylinder walls to be covered by each respective piston-extension, the movement of the extensions can be controlled such that the compressed air is pushed out through one path and the other path permits the entrance of hot air. In this manner, a unidirectional flow is achieved and the compressed air can enter the heating chamber through an outside tube at the other end of the heating chamber, thereby permitting better control of the combustion.

BRIEF DESCRIPTION OF THE DRAWINGS

In the accompanying drawings is:

FIG. 1 a cross-section thru a cylinder and piston showing the upper end of the connecting-rod with the segment of a pinion, a rack and a piston-extension.

FIG. 2 a section thru the wrist-pin, the rack and the piston.

FIG. 3 a P-V diagram showing the positions of the piston, at which the path from the cylinder to the heating-chamber is opened and closed.

DETAILED DESCRIPTION

Figure 5:
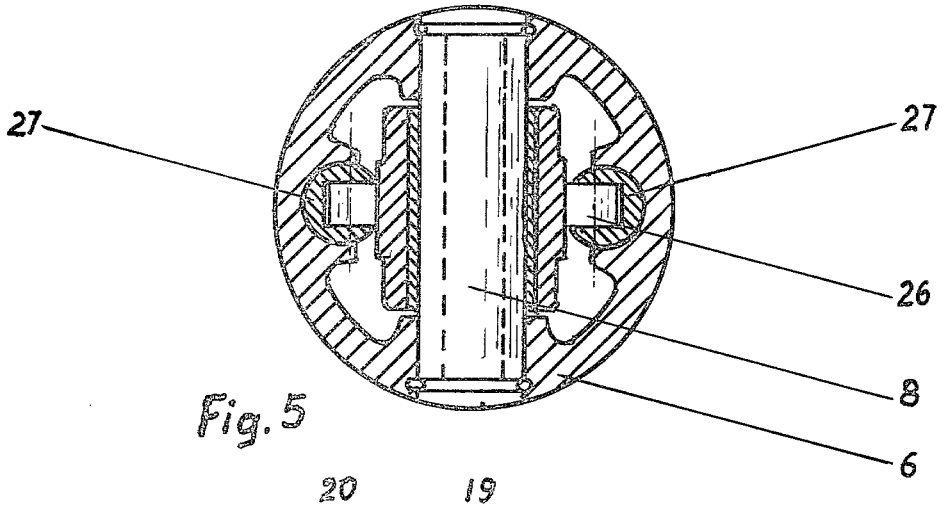
FIG. 5 a section thru the wrist-pin, the pinion, two racks and the piston shown in FIG. 4.

As shown in FIGS. 1 and 2, there is a piston 6 moving in a cylinder 7, pivotally connected by means of a wrist-pin 8 to a connecting-rod 9. The upper end of the connecting-rod 9 carries the segment 10 of a pinion, which engages in a rack 11. The rack 11 has a cylindrical shape, which slides in a hole of the piston 6, in which it is sealed by piston- or O-rings 12. The piston-extension 13, which slides along the cylinder wall and reaches into a pocket 14 of the cylinderhead 15, is engaged to the rack 11 at point 16. The piston-extension 13, which has to seal the path 17, is pressed against the cylinder-wall by a piston 18, which is activated and cooled by circulating pressure-oil thru the holes 19 and 20. The oil is circulated by a circulation-pump in a known manner thru an oil-cooler into a reservoir, where it is put under pressure by connecting the space above the oil-level in the reservoir to the interior of the heating-chamber by a tube. (Circulation-pump, oil-cooler and the heating-chamber are not shown.)

The piston 18 has a recess 21, which is filled with pressurized oil, lubricating and cooling the piston-extension 13. The piston-extension 13 has a hole 22 at its upper end, which leads to a small cavity 23. In the lowest position of the piston the hole 22 communicates with the recess 21 of the piston 18, supplying pressure-oil to the cavity 23 to lubricate the piston-extension at the cylinderwall.

FIG. 3, the P-V diagram shows the positions of the piston ($v_2$ and $V_3$) at which the path 17 to the heating-chamber is opened and closed.

Figure 4:
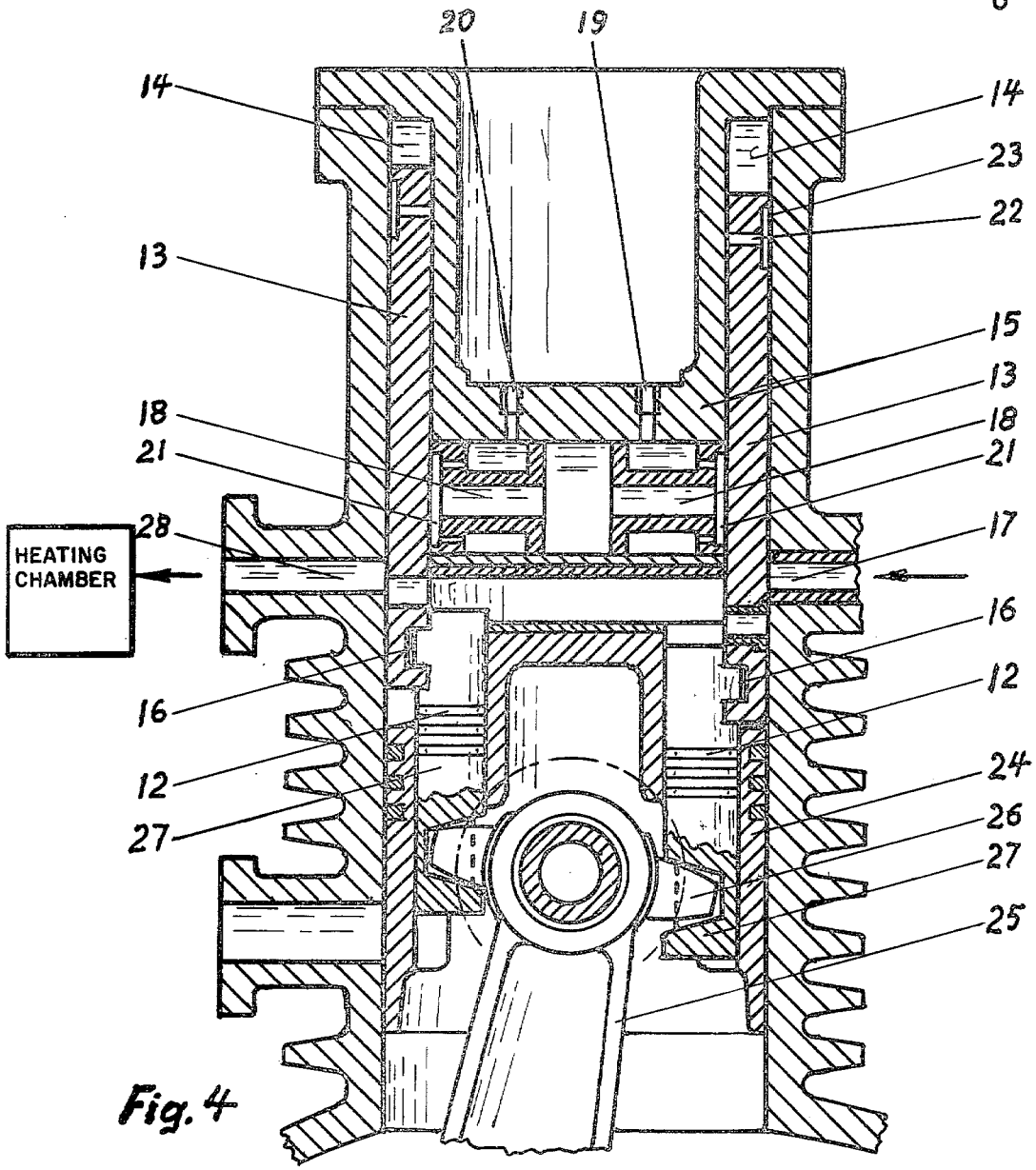
FIG. 4 a cross-section thru a cylinder and piston, where the piston carries two piston-extensions opposing each other and two racks engaging in a pinion at opposite sides.

FIGS. 4 and 5 show a piston 24 and a connecting-rod 25, whose upper end carries two segments of a pinion 26. The pinion 26 engages with two racks 27, one at each side. The pinion 26 has to be made as large as possible. Therefore it is made with only one tooth at each segment. Each tooth engages into a cavity in each rack 27. This design permits a stronger rack 27 and permits a larger pitch diameter of the pinion 26. Both piston-extensions 13 are held against the cylinderwall by two pistons 18, which have recesses 21. Pressure-oil is used in the same way as before to activate the pistons, lubricate and cool them.

The design of FIGS. 1 and 2 with one piston-extension 13 blows the compressed air thru path 17 into the heating-chamber with high velocity in the form of a jet-stream. The jet-stream reaches deep in the back of the heating-chamber and promotes a circulation. The hot gases from the heating-chamber use the same path 17, thru which the compressed air was blown, to enter the cylinder. (Reciprocating flow.)

By using two piston-extensions 13, according FIGS. 4 and 5, and using two passes (17 and 28) to the heating-chamber, the path 28 opens first, leading the compressed air thru an outside tube-connection to the back of the heating-chamber. During the motion of the crankshaft thru the dead-center position the path 28 is closed and the path 17 is opened to permit the hot gases to enter the cylinder at the begin of the down-stroke. (Unidirectional flow.)

The design according FIGS. 4 and 5 (unidirectional flow) offers the possibility, to lead the compressed air thru an heat-exchanger before entering the heating-chamber, to pick up waste-heat from the exhaust-gases. This would save fuel in the heating-chamber and increase the thermal efficiency.

What is claimed is:

1. A cycle controlled sliding valve in a heating chamber combustion engine, comprising:

a housing;

a cylinder defined within said housing;

a piston disposed for movement within said cylinder;

a piston-extension disposed for movement within said cylinder;

a connecting rod having an end pivotally connected to said piston;

a pinion carried by said end of said connecting rod;

a rack positioned within said cylinder and slidable therein, said pinion engaging said rack, and said rack engaging said piston-extension;

a heating chamber;

a path within said housing in communication with said heating chamber; and an opening within said piston-extension positioned such that said path and said opening are aligned, thereby connecting the cylinder and the heating chamber, at least at some point during a working cycle of said piston, whereby said piston and piston-extension are capable of moving axially within said cylinder in a reciprocal manner during the working cycle of said piston, and said piston-extension is capable of moving axially within said cylinder relative to said piston as said connecting rod swings and causes said pinion to move the rack axially within said cylinder, said rack causing said piston-extension to move axially relative to said piston.

2. The invention as defined in claim 1 wherein said rack is positioned within a hole in said piston and slidable within said hole.

3. The invention as defined in claim 2 wherein said rack is sealed within said hole.

4. The invention as defined in claim 1 wherein said piston is connected to said connecting rod by a wrist pin.

5. The invention as defined in claim 1 wherein said path and said opening are positioned such that they are aligned near a dead-center position of said piston.

6. The invention as defined in claim 1 wherein said opening is positioned adjacent an end of the piston.

7. A cycle controlled sliding valve in a heating chamber combustion engine, comprising:

a housing;

a cylinder defined within said housing;

a piston disposed for movement within said cylinder;

first and second opposing piston-extensions disposed for movement within said cylinder;

a connecting rod having an end pivotally connected to said piston;

a pinion carried by said end of said connecting rod;

first and second racks positioned within said cylinder and slidable therein, said pinion engaging each of said racks, said first rack engaging said first piston-extension and said second rack engaging said second piston-extension;

a heating chamber;

first and second paths within said housing, both paths being in communication with said heating chamber, said first path being closable by said first piston-extension and said second path being closable by said second piston-extension;

a first opening within said first piston extension positioned such that said first opening and said first path are aligned, thereby connecting the cylinder and the heating chamber, at least at some point during a working cycle of said piston; and a second opening within said second piston extension positioned such that said second opening and said second path are aligned, thereby connecting the cylinder and the heating chamber, at least at some point during a working cycle of said piston, whereby said piston and said piston-extensions are capable of moving axially within said cylinder in a reciprocal manner during the working cycle of said piston, and said piston-extensions are capable of moving axially within said cylinder relative to said piston as said connecting rod swings and causes said piston to move said racks axially within said cylinder, said racks causing said piston-extensions to move axially relative to said piston.

8. The invention as defined in claim 7 wherein said piston comprises a pair of opposed teeth, one tooth engaging within a cavity in said first rack, the other tooth engaging within a cavity in said second rack.

9. The invention as defined in claim 7 wherein said racks are positioned within respective holes within said piston and slidable within said holes.

10. The invention as defined in claim 9 wherein said racks are sealed within said holes.

11. The invention as defined in claim 7 wherein said piston is connected to said connecting rod by a wrist pin.

12. The invention as defined in claim 7 wherein said paths and said openings are arranged such that said first path and first opening are aligned before said second path and said second opening as said piston moves to compress air within said cylinder.

13. The invention as defined in claim 7 wherein said second path and second opening are positioned to be aligned at a different point in the working cycle of said piston than said first path and first opening.

14. The invention as defined in claim 12 wherein said first path and first opening are positioned such that they are aligned near a dead-center position of said piston.

15. The invention as defined in claim 7 wherein said openings are positioned adjacent an end of said piston.

* * * * *